US007614808B2

(12) United States Patent
Fernandez et al.

(10) Patent No.: US 7,614,808 B2
(45) Date of Patent: Nov. 10, 2009

(54) PRINT MEDIA FEED SYSTEM AND CONTROL METHOD FOR THE SAME

(75) Inventors: David Chanclon Fernandez, Barcelona (ES); Carlos Ciuraneta Sanchez, Barcelona (ES); Marcos Izquierdo, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 393 days.

(21) Appl. No.: 11/650,421

(22) Filed: Jan. 8, 2007

(65) Prior Publication Data

US 2008/0166169 A1 Jul. 10, 2008

(51) Int. Cl.
*B41J 13/02* (2006.01)

(52) U.S. Cl. ..... 400/76; 400/638; 400/639

(58) Field of Classification Search ..... 400/638, 400/639

See application file for complete search history.

(56) References Cited

U.S. PATENT DOCUMENTS

| | | | | |
|---|---|---|---|---|
| 4,846,455 | A * | 7/1989 | Hurst | 271/2 |
| 4,979,691 | A * | 12/1990 | Kobayashi | 242/334.3 |
| 6,018,162 | A * | 1/2000 | Herbst et al. | 250/332 |
| 2007/0145818 | A1 * | 6/2007 | Kobayashi et al. | 303/113.4 |

* cited by examiner

*Primary Examiner*—Daniel J Colilla

(57) ABSTRACT

A print media feed system comprises: a drive unit configured to move a feed roller; a sensing unit configured to sense movement of a feed roller; a detection unit configured to detect movement of a pinch roller; and a controller arranged to control the drive unit using a gain parameter and signals provided by the detection unit and the sensing unit. If it is detected that the pinch roller is in a first position in which the pinch roller presses against the feed roller such that a print media is between the pinch roller and the feed roller, the gain parameter is set to a first value. If it is detected that the pinch roller is not in the first position, the gain parameter is set to a second value which is lower than the first value.

10 Claims, 3 Drawing Sheets

Figure 1 - PRIOR ART

PRINT MEDIA FEED SYSTEM AND CONTROL METHOD FOR THE SAME

FIELD OF THE INVENTION

This invention relates to the field of printing, and more particularly to the field of feeding print media to a printer.

BACKGROUND

Typically, print media is fed to a printer using a mechanism comprising a pinch roller and a feed roller. Such a mechanism is illustrated in FIG. 1.

A pinch roller 1 rotatably mounted on a cylindrical pinch roller support 3 is arranged to press print media 5 against a cylindrical feed roller 7. Feeding of the media 5 is performed by driving the feed roller 7 so that it rotates about its elongate axis and conveys the media 5 by means of friction.

Feeding of the print media 5 is assisted by the pinch roller 1 which contacts the print media 5 when it is being conveyed. Accordingly, the pinch roller 1 is driven by drive means (not shown) to rotate about its elongate axis by virtue of the frictional force between the media 5 and its contacting surface.

To enable setting, loading and releasing of print media within the mechanism, the pinch roller supporter 3 can be swiveled about an axis A so as to describe an arc (indicated generally by the arrow labeled "B"). Thus, the pinch roller 1 and its supporter can be moved into a position C (the "open position"), wherein the pinch roller 1 is detached from the feed roller 7.

In a media feed mechanism such as that shown in FIG. 1, the drive means for driving the feed roller 7 are required to be controlled such that the print media is fed according to requirements, for example at a constant speed. In large format printers such requirements are of utmost importance because the printing accuracy and the speed of the printer can be directly affected by the performance of the media feed mechanism.

It is also desirable to maintain stability of the feed roller 7 when the pinch roller 1 is moved into an open position and the feed roller 7 is moved by an external force. Further, a user may move the pinch roller 1 to an open position during printing, either intentionally or unintentionally. If stability of the feed roller 7 is not maintained, it may vibrate and/or create unwanted noise.

More complicated media feed mechanisms are known which attempt to provide improved performance. However, these are generally unsuitable for lower cost or smaller printers as a direct consequence of their complexity and manufacturing requirements.

Thus, there remains a need for an improved system and/or method for feeding print media to a printer.

BRIEF DESCRIPTION OF THE DRAWINGS

For a better understanding of the invention, embodiments will now be described, purely by way of example, with reference to the accompanying drawings, in which.

DETAILED DESCRIPTION OF THE INVENTION

According to an aspect of the invention, there is provided a control method for a print media feed system. The method comprises the steps of:

detecting whether or not a pinch roller is in a first position in which the pinch roller presses against a feed roller with print media sandwiched therebetween;

if it is detected that the pinch roller is in the first position, setting a gain parameter used by a controller of the print media system to a first value; and if it is detected that the pinch roller is not in the first position, setting the gain parameter to a second value which is lower than the first value.

The invention also provides a computer program comprising computer program code means adapted to perform the method of the invention when said program is run on a computer.

According to another aspect of the invention, there is provided a print media feed system comprising:

drive means for moving a feed roller;

sensing means for sensing movement of a feed roller;

detection means for detecting movement of a pinch roller; and a controller arranged to control the drive means using a gain parameter and signals provided by the detection means and the sensing means.

The system sets the gain parameter to a first value if it is detected that the pinch roller is in a first position in which the pinch roller presses against the feed roller with print media sandwiched therebetween. Conversely, the system sets the gain parameter to a second value which is lower than the first value if it is detected that the pinch roller is not in the first position.

According to yet another aspect of the invention, there is provided a printer comprising a print media feed system according to the invention.

Figure 1:
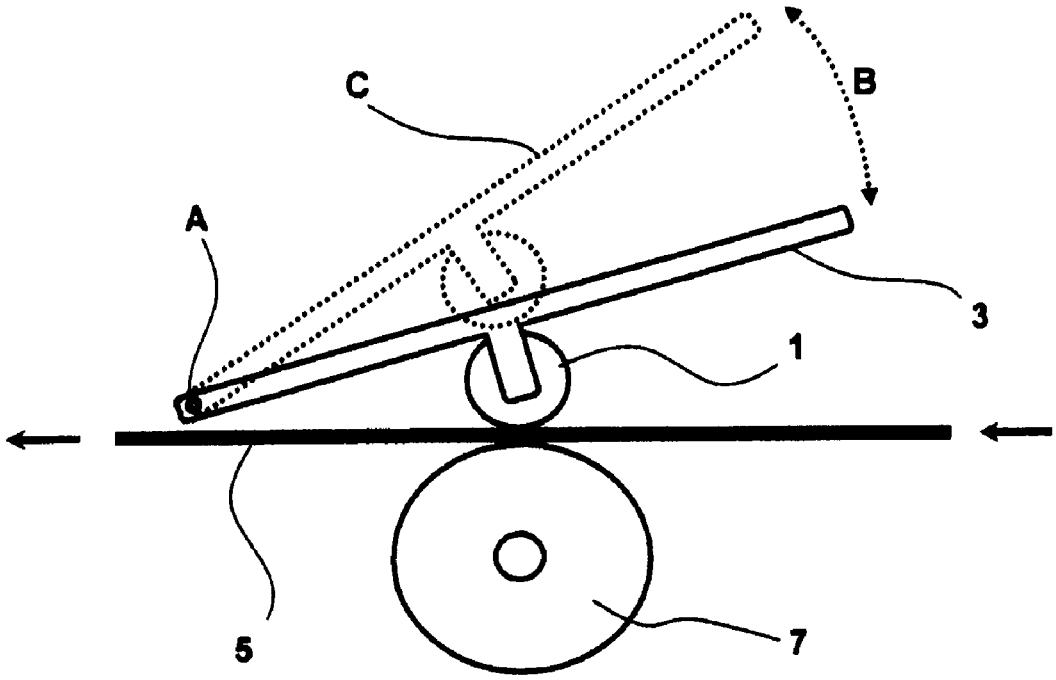
FIG. 1 is an illustration of a known mechanism for feeding media to a printer.
Figure 2:
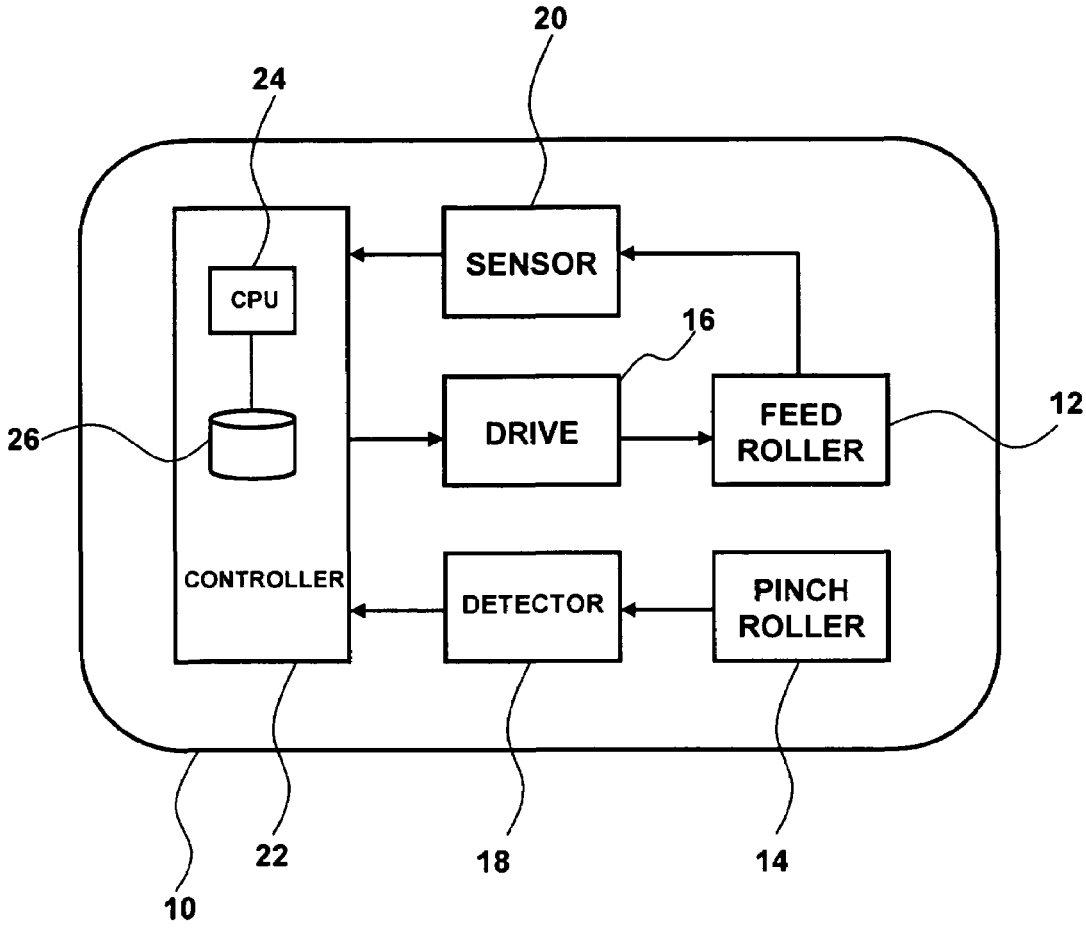
FIG. 2 is a block diagram of a printer according to an embodiment of the invention.

FIG. 2 shows a block diagram of a printer according to an embodiment of the invention. The printer 10 comprises a feed roller 12 and a pinch roller 14, the pinch roller 14 being mounted such that it is movable between an open position and a closed position.

In the open position, the pinch roller 14 is separated from the feed roller 12 such that the pinch roller 14 does not contact print media that is be present between the pinch roller 14 and the feed roller 12.

In the closed position, the pinch roller 14 is arranged to press print media against the feed roller 12. Thus, it will be understood that the pinch roller will still be separated from the feed roller 12 when in the closed position, but this separation will be substantially equal to the thickness of print media present between the pinch roller 14 and the feed roller 12.

In other words, when in the closed position, the pinch roller 14 contacts one side of the print media whilst the feed roller 12 contacts the other side of the print media. Conversely, when in the open position, the feed roller 12 and the pinch roller 14 are separated by a distance that is greater then the thickness of print media that is present between them.

The printer 10 further comprises drive means 16 for driving rotation of the feed roller 12 about a first axis of rotation. The drive means 16 may also be arranged to move the feed roller 12 in any of three orthogonal axes and/or rotate the feed roller about other axes of rotation. Thus, the feed roller 12 can be driven to move print media that is in contact with its surface so as to feed the print media in a desired direction, wherein the print media is moved due to the frictional force that is present between the feed roller 12 and the print media.

Also provided are detection means 18 for detecting movement of the pinch roller 14, and sensing means 20 for sensing movement of the feed roller 12. The detection means 18 and the sensing means 20 are connected to a controller 22 so that signals output by the detection means 18 and the sensing 20 are provided to the controller 22. Based upon the signals provided to it by the detection means 18 and the sensing means 20, the controller 22 is adapted to control the drive means 16.

The controller 22 controls the drive means 16 by outputting a control signal, for example a drive voltage, to the drive means 16. The controller 22 produces this control signal using a gain parameter and the signals provided by the detection means 18 and the sensing means 20. The gain parameter is essentially a multiplier which is used to magnify or scale the signals from the detection means 18 and the sensing means 20 depending upon their significance for controlling the drive means 20.

For example, if it is required to control the drive means 16 with a high level of sensitivity to movement of the feed roller 12, a gain parameter having a high value is preferably applied to signals from the sensing means 20 so as to amplify their magnitude. By using magnified signals from the sensing means 20 to produce its control output, the controller 22 is more sensitive to movements of the feed roller 12 that are sensed by the sensing means 20.

Figure 3:
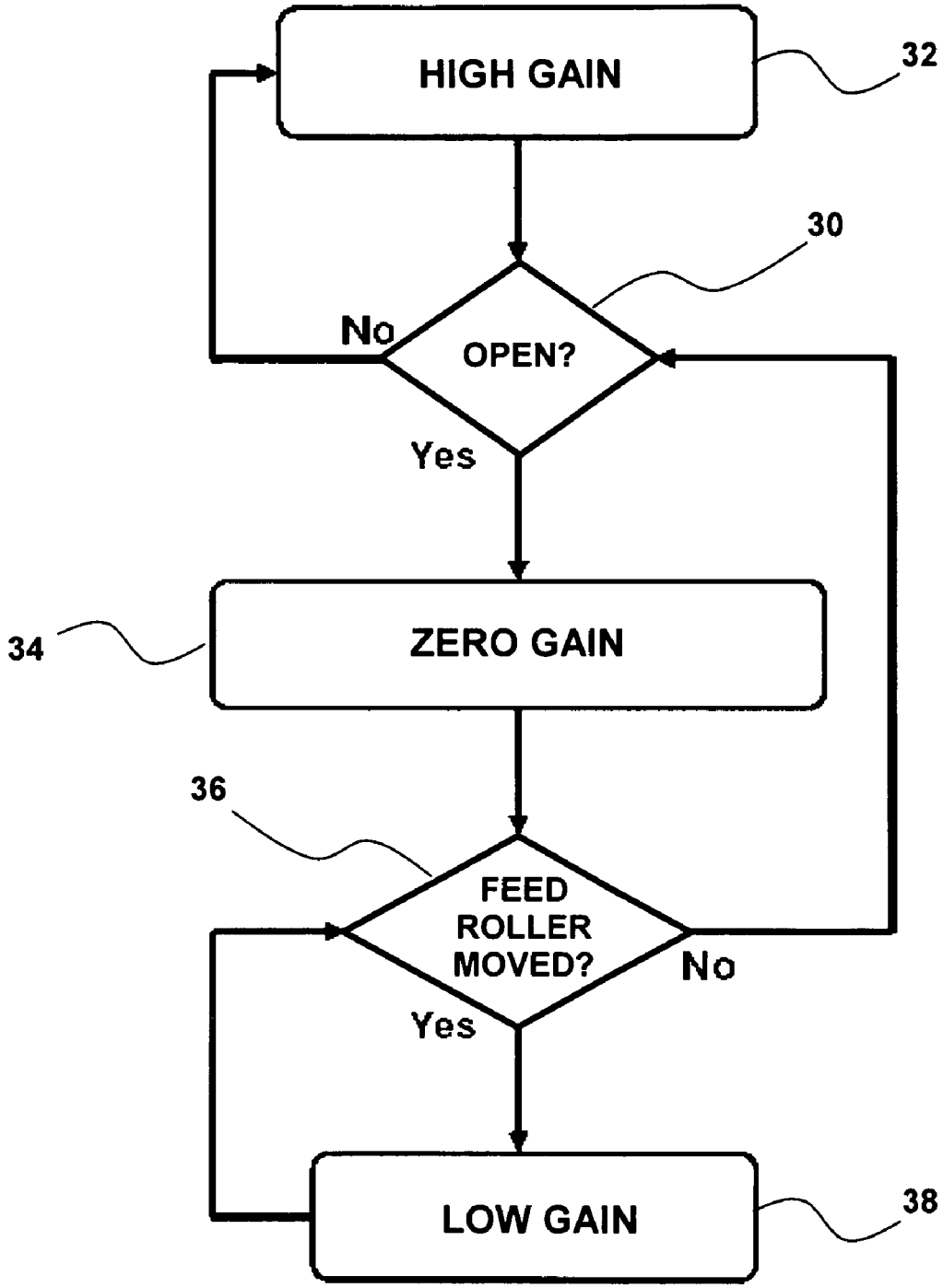
FIG. 3 is a flow diagram of a method for controlling the media feed system of the printer shown in FIG. 2.

Referring now to FIG. 3, a method for controlling a media feed system of the printer shown in FIG. 2 will be described.

The method begins at step 30. In step 30, it is detected whether or not the pinch roller 14 is in an open position. If it is detected that the pinch roller is not in an open position (i.e. the pinch roller is in a closed position for feeding print media to the printer), the method progresses to step 32 in which the gain parameter is set to a high value, preferably substantially greater than one. The method then returns back to step 30.

Since it is preferable for the media feed system to accomplish multiple requirements when feeding media to a printer (i.e. accurately move the media during printing, move the media backwards, and/or maintain the position of the media), the gain parameter is set to a high value so as to make the controller 22 more sensitive to movements of the feed roller 12. Thus, a controller 22 that is highly sensitive to signals from the sensing means 20 may control the drive means so as to achieve improved performance of the media feed system in terms of feeding accuracy.

If, in step 30, it is detected that the pinch roller 14 is in an open position, the method progresses to step 34 in which the gain parameter to a zero value.

When the pinch roller 14 is in an open position, the frictional force that is used to convey the print media is reduced to a minimal or zero value due to the separation of the print media from at least one of the pinch roller 14 and the feed roller 12.

Setting the gain parameter to a zero value results in the controller 22 being highly insensitive to signals from the sensing means. In other words, the controller 22 will not output a drive signal or drive voltage in response to signals it receives from the sensing means 20. Without setting the controller 22 to be insensitive to movements of the feed roller 12, the feed roller 12 may be unnecessarily controlled and driven which can result in undesirable vibrations of the feed roller 12 and even erroneous conditions that may damage sensitive components of the media feed system.

Preferably, the detecting means 18 and the method is arranged to detect movement of the pinch roller 14 towards the open position before the pinch roller 14 reaches an open position. In this way, instability of the media feed system at the instance the pinch wheel moves to an open position can be avoided.

Although not essential, it is preferable to maintain stability of the feed roller 12 within the media feed system when the pinch roller is in an open position, but moved by an external force (for example, human contact and/or vibrations).

Thus, after setting the gain parameter to a zero value in step 34, the method may progress to optional (but preferable) steps 36 and 38.

In step 36, it is sensed whether or not the feed roller 12 moves. If no movement of the feed roller 12 is sensed, the method returns to step 30. However, if movement of the feed roller 12 is sensed, the method proceeds to step 38 in which the gain parameter is set to a low, non-zero value, preferably less than one. The method then returns to step 36.

Since it is preferable for the media feed system to maintain stability of when the pinch roller 14 is in an open position (i.e. when new print media is being loaded to the media feed system), the gain parameter is set to a low value so as to make the controller 22 partly sensitive to movements of the feed roller 12. In this way, the controller 22 may control the drive means 16 so as to cater for large movements in the feed roller (which may damage component of the media feed system) whilst not compromising the stability of the media feed system. Thus, the system would otherwise become unstable if the controller 22 attempted to apply high levels of feedback control to cater for small movements of the feed roller 12.

Of course, it will be understood that if the method does not include preferable step 36 and 38, the method should be adapted to return to step 30 after completing step 34.

A computer program may be adapted to perform the method of the invention. Thus, the controller 22 may comprise a processor 24 and memory means 26 for storing the computer program, wherein the processor 24 is arranged to run the computer program in order to control the media feed system of the printer 10.

Such a computer program may also be embodied on a computer readable medium for use by a suitably arranged system.

Some of the advantages provided by the invention can be summarized as follows:

- the invention may be easily implemented in existing media feed systems;
- the invention avoids a print media feed system becoming instable when the pinch roller is moved to an open position;
- the stability of the print media feed system can also be maintained once when the pinch roller is held in an open position; and
- the invention avoids the need for additional hardware solutions like braking systems which result in additional costs, reliability issues, acoustic noise, and manufacturing problems.

While specific embodiments have been described herein for purposes of illustration, various modifications will be apparent to a person skilled in the art and may be made without departing from the scope of the invention.

We claim:

1. A control method for a print media feed system comprising: a drive unit configured to move a feed roller; a sensing unit configured to sense movement of a feed roller; a detection unit configured to detect movement of a pinch roller; and a controller arranged to control the drive unit using a gain parameter and signals provided by the detection unit and the sensing unit, the method comprising the steps of:

detecting whether the pinch roller is in a first position in which the pinch roller presses against the feed roller such that a print media is between the pinch roller and the feed roller;

setting the gain parameter to a first value when the pinch roller is detected in the first position; and setting the gain parameter to a second value which is lower than the first value when the pinch roller is not detected in the first position.

2. A control method as claimed in claim 1, wherein the second value is substantially equal to zero.

3. A control method as claimed in claim 1, wherein the first value is greater than one.

4. A control method for a print media feed system comprising: a drive unit configured to move a feed roller; a sensing unit configured to sense movement of a feed roller; a detection unit configured to detect movement of a pinch roller; and a controller arranged to control the drive unit using a gain parameter and signals provided by the detection unit and the sensing unit, the method comprising the steps of:

detecting whether the pinch roller is in a first position in which the pinch roller presses against the feed roller such that a print media is between the pinch roller and the feed roller;

setting the gain parameter to a first value when the pinch roller is detected in the first position;

sensing movement of the feed roller when the pinch roller is not detected in the first position;

setting the gain parameter to a second value which is lower than the first value when the pinch roller is not detected in the first position and movement of the feed roller is not sensed; and setting the feedback gain parameter to a third value, wherein the third value is greater than the second value and less than the first value when the pinch roller is not detected in the first position and movement of the feed roller is sensed.

5. A computer-readable medium having embodied therein computer code which when executed causes control of a print media feed system having a drive unit configured to move a feed roller; a sensing unit configured to sense movement of a feed roller; a detection unit configured to detect movement of a pinch roller; and a controller arranged to control the drive unit using a gain parameter and signals provided by the detection unit and the sensing unit, the control comprising the steps of:

detecting whether the pinch roller is in a first position in which the pinch roller presses against the feed roller such that a print media is between the pinch roller and the feed roller;

setting a gain parameter to a first value when the pinch roller is detected in the first position; and setting the gain parameter to a second value which is lower than the first value when the pinch roller is not detected in the first position.

6. A print media feed system comprising:

a drive unit configured to move a feed roller;

a sensing unit configured to sense movement of a feed roller;

a detection unit configured to detect movement of a pinch roller; and a controller arranged to control the drive unit using a gain parameter and signals provided by the detection unit and the sensing unit, wherein the controller sets the gain parameter to a first value when the pinch roller is detected in a first position in which the pinch roller presses against the feed roller with a print media between the pinch roller and the feed roller, and wherein the controller sets the gain parameter to a second value lower than the first value when the pinch roller is not detected in the first position.

7. A print media feed system as claimed in claim 6, wherein the second value is substantially equal to zero.

8. A print media feed system as claimed in claim 6, wherein the first value is greater than one.

9. A printer comprising a print media feed system as claimed in claim 6.

10. A print media feed system comprising:

a drive unit configured to move a feed roller;

a sensing unit configured to sense movement of a feed roller;

a detection unit configured to detect movement of a pinch roller; and a controller arranged to control the drive unit using a gain parameter and signals provided by the detection unit and the sensing unit;

wherein the controller sets the gain parameter to a first value when the pinch roller is detected in a first position such that the pinch roller presses against the feed roller with a print media between the pinch roller and the feed roller;

wherein the controller sets the gain parameter to a second value lower than the first value when the pinch roller is not detected in the first position and movement of the feed roller is not sensed;

and wherein the controller sets the gain parameter to a third value when the pinch roller is not detected in the first position and movement of the feed roller is sensed, the third value being greater than the second value and less than the first value.

* * * * *